US005481232A

United States Patent [19]

Wu et al.

[11] Patent Number: 5,481,232

[45] Date of Patent: Jan. 2, 1996

[54] OPTICALLY CONTROLLED MULTILAYER COPLANAR WAVEGUIDE PHASE SHIFTER

[75] Inventors: Shih-Chang Wu, Parsippany; Haim Grebel, Livingston, both of N.J.

[73] Assignee: New Jersey Institute of Technology, Newark, N.J.

[21] Appl. No.: 424,210

[22] Filed: Apr. 19, 1995

[51] Int. Cl.[6] ..... H01P 1/18

[52] U.S. Cl. ..... 333/161; 333/246

[58] Field of Search ..... 333/161, 164, 333/205, 81 A, 246; 257/82; 327/187, 369, 514

[56] References Cited

U.S. PATENT DOCUMENTS

| | | | |
|---|---|---|---|
| 4,263,570 | 4/1981 | De Fonzo et al. | 333/157 |
| 4,675,624 | 6/1987 | Rosen et al. | 333/161 |
| 4,751,513 | 6/1988 | Daryoush et al. | 347/700 MS |
| 4,835,500 | 5/1989 | Sequeira | 333/258 |
| 5,099,214 | 3/1992 | Rosen et al. | 333/157 |
| 5,385,883 | 1/1995 | Lenzing et al. | 333/161 X |

*Primary Examiner*—Paul Gensler
*Attorney, Agent, or Firm*—Klauber & Jackson

[57] ABSTRACT

A multilayer coplanar waveguide having a fine-patterned conductive top cover coated with a photosensitive material for optically controlling the phase shift within the waveguide. The multilayer coplanar waveguide comprises a conductive ground plane, a first dielectric layer formed on the conductive ground plane, a second dielectric layer formed on the first dielectric layer, a conductive signal carrier and a pair of conductive floating ground planes flanking the conductive signal carrier formed on the second dielectric layer, a third dielectric layer formed on the conductive signal carrier, the pair of conductive floating ground planes, and the second dielectric layer, fine-patterned conductive strips formed on the third dielectric layer, and a photosensitive material layer formed on the fine-patterned conductive strips and the third dielectric layer. The photosensitive material, when illuminated, generates free electrons which drift toward the conductive strips thereby increasing the resistance between the conductive strips and increasing the phase delay of signals propagating through the waveguide. Thus, the phase shift within the multilayer coplanar waveguide is optically controllable.

33 Claims, 5 Drawing Sheets

OPTICALLY CONTROLLED MULTILAYER COPLANAR WAVEGUIDE PHASE SHIFTER

FIELD OF THE INVENTION

The present invention relates generally to coplanar waveguides and, more particularly, to a multilayer coplanar waveguide having a fine-patterned conductive top cover coated with a photosensitive material for optically controlling the phase shift within the waveguide.

DESCRIPTION OF THE PRIOR ART

As the complexity of microwave systems increases, more multifunction monolithic microwave integrated circuits (MMICs) rely on the controllable microwave devices to accomplish their objectives. In coplanar waveguide (CPW) applications, several optically/electronically controlled CPW phase shifters have been reported. The common method to yield a controllable phase shift has been to alter the substrate material characteristics optically/electronically. Such an alteration results in a change in the CPW dispersion characteristic so as to cause a phase delay after a constant distance of wave propagation. Schottky-contacted CPWs were designed and studied under this concept (see K. Kaiser et al., Variable Phase Shift of Spatially Periodic Proton-Bombarded Schottky Coplanar Lines, Electron. Lett., Vol. 25, pp. 1135–36, Sept. 1989; P. Cheung et al., Optically Controlled Coplanar Waveguide Phase Shifters, IEEE Trans. Microwave Theory Tech., Vol. MTT-38, pp. 586–95, May 1990). However, since a lossy depletion layer is located in the high-field region, Schottky-contacted CPWs possess high attenuation constants.

Other methods have been conceived for optically controlling phase shifts. For example, U.S. Pat. Nos. 4,835,500 to Sequeira, 4,675,624 to Rosen et al., 4,263,570 to De Fonzo et al., 5,099,214 to Rosen et al., and 4,751,513 to Daryoush et al. are all directed toward optically controlling phase shifts. A brief description of these patents will now be given.

In U.S. Pat. No. 4,835,500, Sequeira discloses a multilayer-dielectric slab structure comprising a metal ground plane, a dielectric substrate layer ($\epsilon s$) formed on the metal ground plane, a dielectric guiding slab layer ($\epsilon g$; $\epsilon g > \epsilon s$) formed on the dielectric substrate layer, a dielectric loading strip layer ($\epsilon l$; $\epsilon l < \epsilon g$) formed on the dielectric guiding slab layer, and a metal conductor formed on the dielectric loading strip layer. The multilayer dielectric slab structure is to be used in optically controlled switches and phase shifters. It should be noted that this patent lacks a teaching of a photosensitive fine-patterned top cover.

In U.S. Pat. No. 4,675,624, Rosen et al. disclose a transmission line device for shifting the phase of an electrical signal propagating therealong in response to light from a light source. The transmission line device comprises a pair of elongated conductors and a semiconductor junction formed between the conductors so as to form a capacitance between the pair of conductors. When the semiconductor junction is illuminated, the characteristics of the semiconductor junction are changed thereby changing the capacitance between the conductors. It should be noted that this patent lacks a teaching of a photosensitive fine-patterned top cover.

In U.S. Pat. No. 4,263,570, De Fonzo et al. disclose a reciprocal phase shifter for optically controlling the phase of an electrical signal. The reciprocal phase shifter comprises a waveguide either formed of an interaction material or having an interaction material attached thereto wherein the interaction material absorbs light and forms a plasma of electron-hole pairs therewithin. The plasma interacts with the electrical signal, which is propagating along the waveguide, so as to change the speed of the signal, thereby changing the phase of the signal. It should be noted that this patent lacks a teaching of a photosensitive fine-patterned top cover.

In U.S. Pat. No. 5,099,214, Rosen et al. disclose a waveguide comprising an optically activated phase shifter and attenuator. The waveguide is constructed in generally typical fashion, except that an aperture is formed in one of the waveguide walls so as to allow light to illuminate the opening. A semiconductor slab is positioned within the waveguide for illumination, and the slab, when illuminated, induces plasma therewithin. The induced plasma alters the propagation characteristics of the waveguide. It should be noted that this patent lacks a teaching of a photosensitive fine-patterned top cover.

In U.S. Pat. No. 4,751,513, Daryoush et al. disclose an antenna having a photosensitive element connected between two radiating elements so as to control the electromagnetic radiation given off by the antenna. This invention is mainly directed toward fine tuning the frequency at which the antenna is radiating. It should be noted that this patent lacks a teaching of a photosensitive fine-patterned top cover.

While all of the above-described patents are directed toward optically controlling phase shifts, none are directed toward a multilayer coplanar waveguide having a fine-patterned conductive top cover coated with a photosensitive material for optically controlling the phase shift within the waveguide. Such a waveguide would be easy to manufacture and would be able to operate over a wide range of frequencies. Thus, it would be both novel and desirable to provide such a waveguide.

SUMMARY OF THE INVENTION

The present invention contemplates a multilayer coplanar waveguide having a fine-patterned conductive top cover coated with a photosensitive material for optically controlling the phase shift within the waveguide. The multilayer coplanar waveguide comprises a conductive ground plane, a first dielectric layer formed on the conductive ground plane, a second dielectric layer formed on the first dielectric layer, a conductive signal carrier and a pair of conductive floating ground planes flanking the conductive signal carrier formed on the second dielectric layer, a third dielectric layer formed on the conductive signal carrier, the pair of conductive floating ground planes, and the second dielectric layer, fine-patterned conductive strips formed on the third dielectric layer, and a photosensitive material layer formed on the fine-patterned conductive strips and the third dielectric layer. The photosensitive material, when illuminated, generates free electrons thereby changing the effective resistance between the conductive strips and changing the phase delay of signals propagating through the waveguide. Thus, the phase shift within the multilayer coplanar waveguide is optically controllable.

Accordingly, the primary objective of the present invention is to provide a multilayer coplanar waveguide having a fine-patterned conductive top cover coated with a photosensitive material for optically controlling the phase shift within the coplanar waveguide.

Other objectives and advantages of the present invention will become apparent to those skilled in the art upon reading the following detailed description and claims, in conjunction with the accompanying drawings which are appended hereto.

BRIEF DESCRIPTION OF THE DRAWINGS

In order to facilitate a fuller understanding of the present invention, reference is now be made to the appended drawings. The drawings should not be construed as limiting the present invention, but are intended to be exemplary only.

DETAILED DESCRIPTION OF THE PRESENT INVENTION

The dominant propagating mode in coplanar waveguides is the TEM mode. When fine-patterned conductive strips are placed on the top cover of a coplanar waveguide, the propagating electric field is perpendicular to the conductive strips and the effective permittivity is increased (see H. Grebel et al., Conditional Artificial Dielectrics: Phase and Amplitude Response at Microwave Frequencies, IEE Proc., Vol. 14, pp. 232–236, 1993 and R. E. Collin, Field Theory of Guided Waves, 2nd ed., New York: IEEE Press, 1991). Consequently, the phase constant of the propagating mode in the coplanar waveguide is increased. On the other hand, a coplanar waveguide having a uniformly conductive top cover yields a lower phase constant. Thus, the phase constant of the propagating mode in a coplanar waveguide having a top cover with fine-patterned conductive strips is higher than that associated with a coplanar waveguide having a uniformly conductive top cover. This change is larger than the phase constant change between coplanar waveguides having uniformly conductive top covers and plain dielectric top covers.

I. MULTILAYER COPLANAR WAVEGUIDE DESIGN

Figure 1:
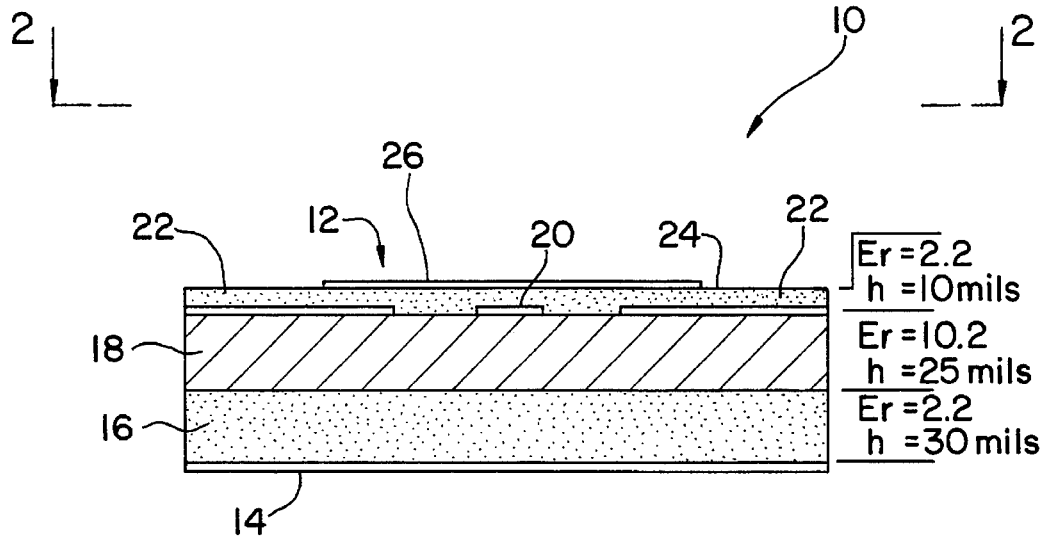
FIG. 1 is a cross-sectional end view of a coplanar waveguide having a fine-patterned conductive top cover according to the present invention.
Figure 2:
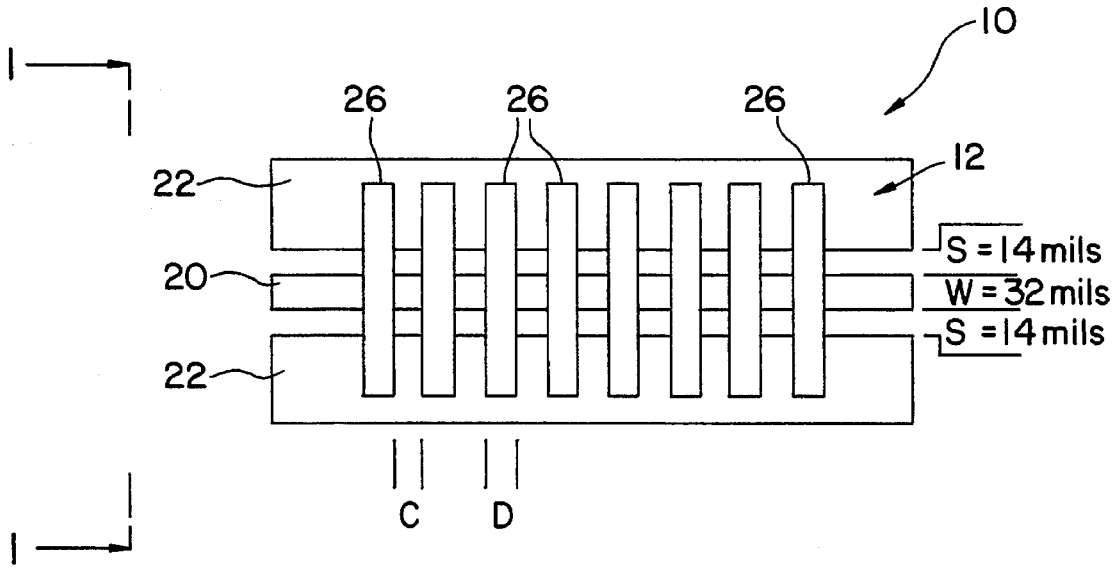
FIG. 2 is a top view of the conductive signal carrier, the pair of conductive floating ground planes, and the plurality of fine-patterned conductive strips in the coplanar waveguide shown in FIG. 1 taken along line 2—2 of FIG. 1.

Referring to FIGS. 1 and 2, there is shown a multilayer coplanar waveguide 10 having a fine-patterned conductive top cover 12 according to the present invention. The entire multilayer coplanar waveguide 10 comprises a conductive ground plane 14, a first dielectric layer 16 formed on the conductive ground plane 14, a second dielectric layer 18 formed on the first dielectric layer 16, a conductive signal carrier 20 and a pair of conductive floating ground planes 22 flanking the conductive signal carrier 20 formed on the second dielectric layer 18, a third dielectric layer 24 formed on the conductive signal carrier 20, the pair of conductive floating ground planes 22, and the second dielectric layer 18, and a plurality of fine-patterned conductive strips 26 formed on the third dielectric layer 24.

The dimensions of the conductor-backed multilayer coplanar waveguide 10 were chosen by using a full-wave method so as to achieve a 50 Ωcharacteristic impedance when the third dielectric layer 24 is in place. Also, the third dielectric layer 24 was chosen to have a low dielectric constant ($\epsilon$=2.2) so as to yield a reduction in the phase constant if a uniformly conductive top cover was applied. The length of each of the fine-patterned conductive strips 26 is at least three times the dimension (2S+W), while the width of each of the conductive floating ground planes 22 is at least equal to the dimension (2S+W).

The multilayer structure was designed so that the coplanar waveguide 10 is a non-leaky transmission line over the range of frequency of interest (i.e. from 0.0 to 10.0 GHz). According to calculations, the percentage of propagated power inside the third dielectric layer 24 is 30.15% at 5 GHz without any conductive top cover, and 68.05% at 5 GHz with a uniformly conductive top cover.

It should be noted that the conductive ground plane 14 and the first dielectric layer 16 are not required elements of the multilayer coplanar waveguide 10 and are provided only for support and isolation purposes.

II. EXPERIMENTAL FINDINGS

A test fixture having two soldered coplanar waveguide coaxial connectors was fabricated for a plurality of multilayer coplanar waveguides 10 so as to provide an identical measurement environment throughout the entire experiment. Two sets of patterned conductive strips 26 were fabricated on the third dielectric layer 24. In the first set, the patterns were: 1.) C/D=10 mils/4 mils; 2.) C/D=10 mils/50 mils; 3.) C/D=10 mils/100 mils; and 4.) C/D=10 mils/200 mils. In the second set, the patterns were: 1.) C/D=4 mils/4 mils; 2.) C/D=4 mils/25 mils; 3.) C/D=4 mils/50 mils; and 4.) C/D=4 mils/100 mils. Measurements were performed by an HP 8510C automatic network analyzer with two-port calibration to the ends of the coplanar waveguide coaxial connectors. All the measured data were recorded with transmission coefficients greater than −2 dB to ensure a minimum measured phase error.

Figure 3:
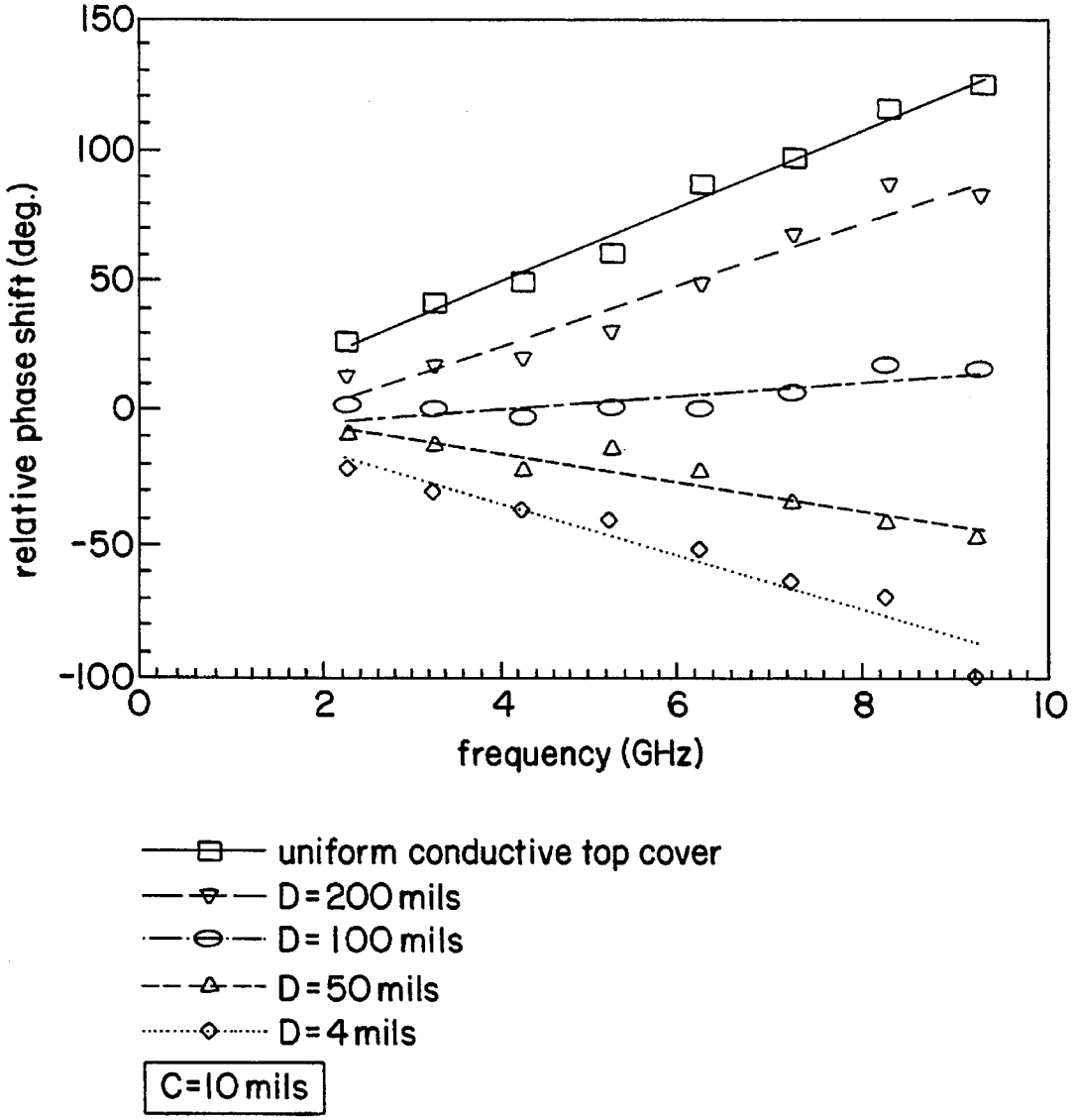
FIG. 3 is a graph indicating the relative phase shift as a function of frequency for signals propagating through coplanar waveguides having various patterned conductive top covers.

The phase delay for a multilayer coplanar waveguide having a third dielectric layer 24 but no conductive top cover was measured and serves as a coordinate reference value. Also, the phase delay for a multilayer coplanar waveguide having a third dielectric layer 24 and a uniform conductive top cover was measured and serves as a plotted reference value. The frequency responses of the relative phase shifts of the first set of multilayer coplanar waveguides 10 (C=10 mils) are shown in FIG. 3. As can be seen from FIG. 3, the smaller the conductive strip width, the faster the wave propagates. It should be noted that the transmission coefficient of the multilayer coplanar waveguide 10 is $e^{-jBl}$. The relative phase shift is defined as $\theta=-\beta L+\beta_d L$, where L is the length of the multilayer coplanar waveguide 10, $\beta_d$ is the phase constant of the multilayer coplanar waveguide having the third dielectric layer 24 but no conductive top cover, and $\beta$ is the phase constant of the multilayer coplanar waveguide 10 having a third dielectric layer 24 and patterned conductive strips 26. Thus, a negative relative phase shift represents an increase in the phase delay.

Figure 4:
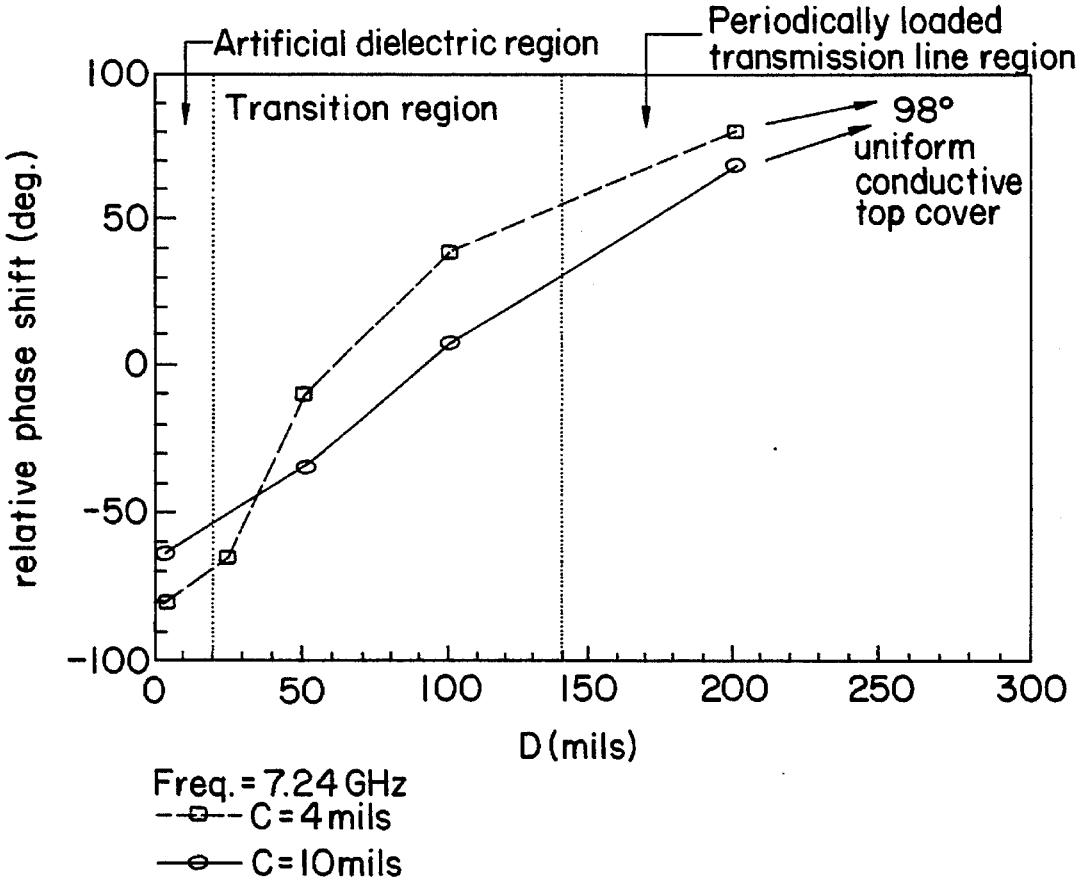
FIG. 4 is a graph indicating the relative phase shift as a function of conductive strip width for signals propagating through coplanar waveguides having various patterned conductive top covers.

Referring to FIG. 4, the relative phase shifts are shown as a function of conductive strip width for signals propagating at 7.24 GHz through the multilayer coplanar waveguides 10 having the various patterned conductive top covers 12. The solid line represents the relative phase shift of the multilayer coplanar waveguides having a 10-mil spacing patterned conductive top cover 12, while the dashed line represents the relative phase shift of the multilayer coplanar waveguides having a 4-mil spacing patterned conductive top cover 12. Both curves show that the relative phase shift is negative for a fine-patterned top cover 12. Both curves saturate at 98° for a uniformly conductive top cover. The smaller the spacing C, the larger the (negative) relative phase shift. It is also seen that the relative phase shift reaches the saturated value faster when the spacing is smaller (C=4 mils).

The experimental observations reveal an important potential application of controllable microwave phase shifters. The phase delay is very sensitive to the geometry of the fine-patterned conductive top cover 12. Slight changes in the spacing C or the conductive strip width D can result in a dramatic phase shift. Thus, considerable phase shift can by gained by designing a multilayer coplanar waveguide having a fine-patterned conductive top cover coated with a photosensitive material and applying light illumination thereto. Unlike the Schottky-contacted coplanar waveguides described in the prior art, the photosensitive material under illumination is still a semi-insulator. Thus, attenuation losses are minimized.

III. APPLICATION OF EXPERIMENTAL FINDINGS

Figure 5:
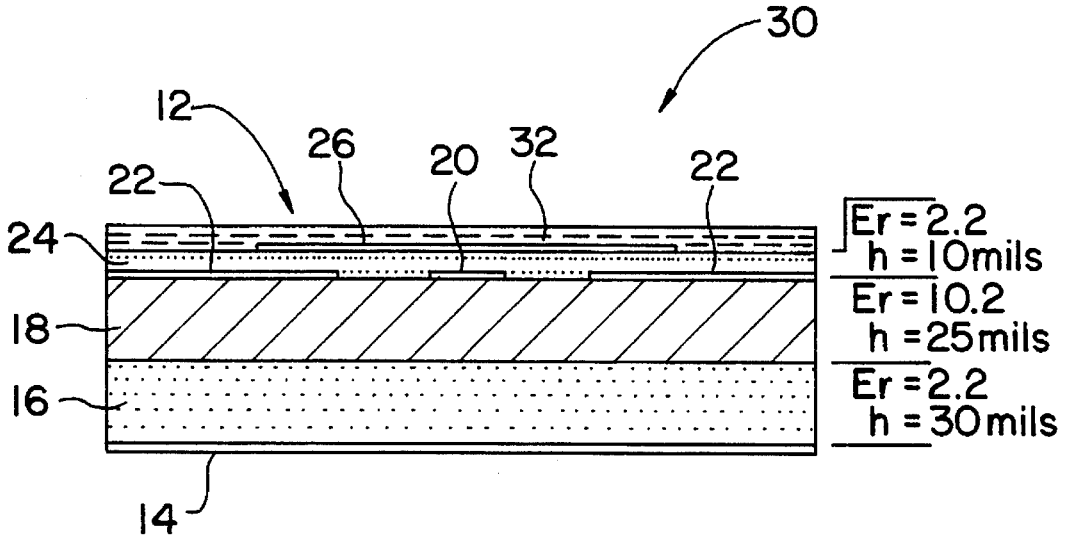
FIG. 5 is a cross-sectional end view of a coplanar waveguide having a fine-patterned conductive top cover coated with a photosensitive material layer according to the present invention.

The concept discovered in the above-discussed experiment was demonstrated on a multilayer coplanar waveguide 30 having a fine-patterned conductive top cover 12 coated with a photosensitive material layer 32. Referring to FIG. 5, there is shown such a multilayer coplanar waveguide 30. The entire multilayer coplanar waveguide 30 comprises a conductive ground plane 14, a first dielectric layer 16 formed on the conductive ground plane 14, a second dielectric layer 18 formed on the first dielectric layer 16, a conductive signal carrier 20 and a pair of conductive floating ground planes 22 flanking the conductive signal carrier 20 formed on the second dielectric layer 18, a third dielectric layer 24 formed on the conductive signal carrier 20, the pair of conductive floating ground planes 22, and the second dielectric layer 18, a plurality of fine-patterned conductive strips 26 (making up the fine-patterned conductive top cover 12) formed on the third dielectric layer 24, and the photosensitive material layer 32 formed on the fine-patterned conductive strips 26 and the third dielectric layer 24. The geometries of the multilayer coplanar waveguide 30 shown in FIG. 5 (except that of the photosensitive material layer 32) are identical to the multilayer coplanar waveguide 10 shown in FIG. 1, and thus the layers are numbered the same.

The photosensitive material 32 in this particular case was chosen to be the semiconductor cadmium sulfur (CdS). It should be noted, however, that other photosensitive semiconductor materials may be utilized, such as a semiconductor cluster like silicon, and photosensitive materials which are not semiconductors may also be utilized, such as a photoconductive material like polyvinylcarbazole (PVK).

The conductive strip width D was chosen to be 4 mils, and the spacing C was chosen to be 8 mils. The CdS semiconductor was evaporated from a crucible so as to form a layer 0.04 mils thick.

It should again be noted that the conductive ground plane 14 and the first dielectric layer 16 are not required elements of the multilayer coplanar waveguide 30 and are provided only for support and isolation purposes.

Figure 6:
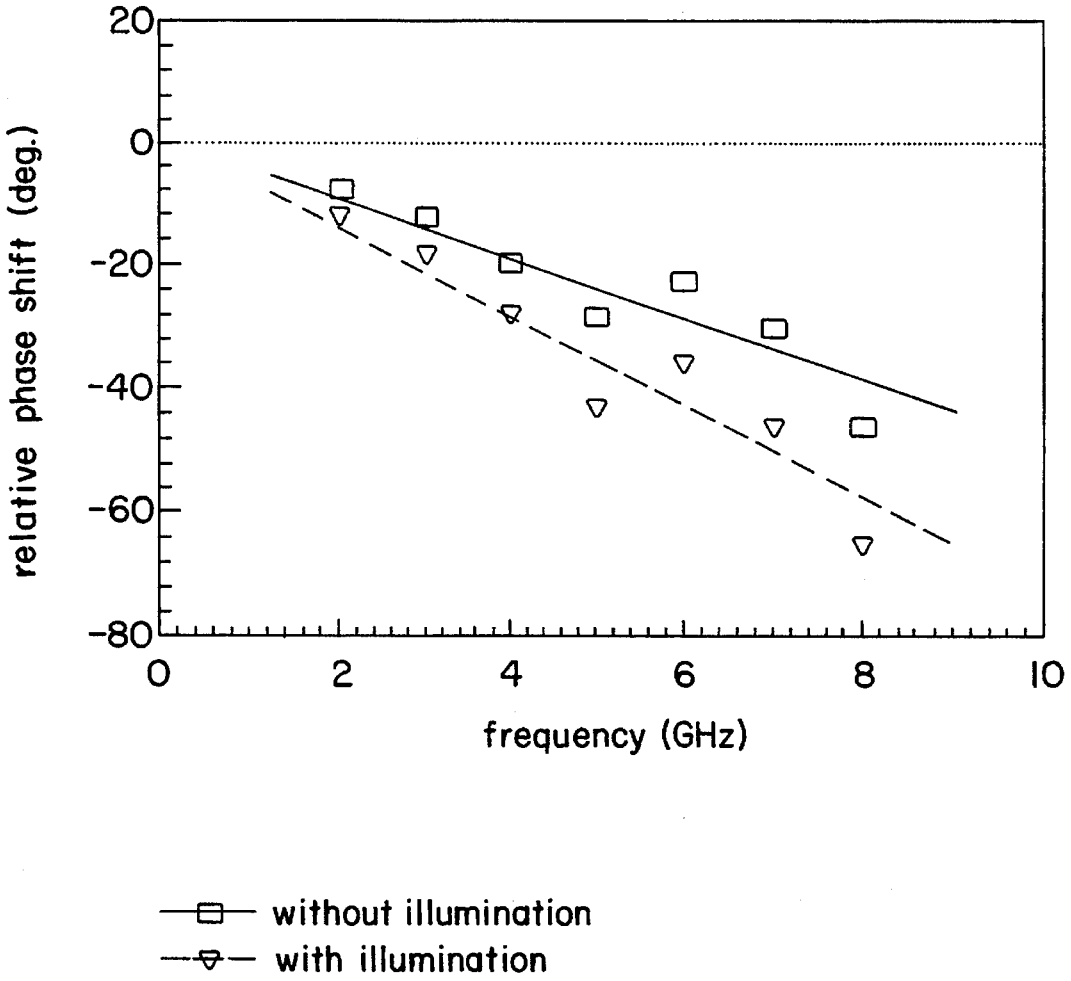
FIG. 6 is a graph indicating the relative phase shift as a function of frequency for signals propagating through an illuminated/non-illuminated coplanar waveguide having a fine-patterned conductive top cover coated with a photosensitive material layer.

The demonstration was conducted under illumination from a white light source and under no illumination. Since thermal disturbances are an inherent quantity of white light sources, the results were referenced to an illuminated multilayer coplanar waveguide having a third dielectric layer 24 and fine-patterned conductive strips 26 but no photosensitive material layer 32 so as to insure that the demonstrated phase shift is purely optical. The illumination power at the relevant CdS absorption region was estimated to be 0.33 $W/cm^2$. Owing to the relatively slow response time of the CdS material, two temporal responses were observed when white light illumination was applied. The fast response gave a decreasing phase delay (low surface resistance), and the steady state response yielded an increasing phase delay (high surface resistance). The results for the latter case (after 10 seconds of illumination) are shown in FIG. 6. The steady state case resembles transparency conditions of highly illuminated semiconductor materials (see A. Yariv, Optical Electronics, 4th ed., New York: Holt, Rinehart, and Winston, 1991). Thus, as the resistance between conductive strips increases, the phase delay indeed increases as seen in FIG. 6. Additional insertion losses under illumination as compared to the non-illuminated case were less than 0.2 dB/inch for all measured frequencies.

IV. CONCLUSIONS

It has been demonstrated that the dispersion characteristics of a multilayer coplanar waveguide can be freely controlled without restriction on the available dielectric material by patterning a conductive top cover. In addition, it has been demonstrated that the phase shift within a multilayer coplanar waveguide can be optically controlled by forming a photosensitive fine-patterned top cover on the multilayer coplanar waveguide and applying light illumination thereto. In summary, the present invention relates to a multilayer coplanar waveguide 30 having a fine-patterned conductive top cover 12 coated with a photosensitive material layer 32 for optically controlling the phase shift within the waveguide 30.

With the present invention coplanar waveguide 30 now fully described, it can thus be seen that the primary objective set forth above is efficiently attained and, since certain changes may be made in the above-described coplanar waveguide 30 without departing from the scope of the invention, it is intended that all matter contained in the above description or shown in the accompanying drawings shall be interpreted as illustrative and not in a limiting sense.

What is claimed is:

1. A multilayer coplanar waveguide phase shifter, said multilayer coplanar waveguide phase shifter comprising:

a first dielectric layer;

a conductive signal carrier and at least one first conductive ground plane flanking said conductive signal carrier, said conductive signal carrier and said at least one first conductive ground plane formed on said first dielectric layer;

a second dielectric layer formed on said conductive signal carrier, said at least one first conductive ground plane, and said first dielectric layer;

a plurality of fine-patterned conductive strips formed on said second dielectric layer; and a photosensitive material layer formed on said plurality of fine-patterned conductive strips and said second dielectric layer.

2. The multilayer coplanar waveguide phase shifter as defined in claim 1, wherein said first dielectric layer has a higher dielectric constant than said second dielectric layer.

3. The multilayer coplanar waveguide phase shifter as defined in claim 1, wherein said plurality of fine-patterned conductive strips are oriented perpendicular to said conductive signal carrier.

4. The multilayer coplanar waveguide phase shifter as defined in claim 1, wherein said at least one first conductive ground plane comprises two first conductive ground planes each laterally flanking said conductive signal carrier.

5. The multilayer coplanar waveguide phase shifter as defined in claim 4, wherein said conductive signal carrier has a width W, wherein said two first conductive ground planes are separated from said conductive signal carrier by a distance S, and wherein each of said plurality of fine-patterned conductive strips have a length of at least three times the dimension (2S+W).

6. The multilayer coplanar waveguide phase shifter as defined in claim 5, wherein said two first conductive ground planes each have a width that is at least equal to the dimension (2S+W).

7. The multilayer coplanar waveguide phase shifter as defined in claim 1, wherein said photosensitive material layer comprises a photosensitive semiconductor material layer.

8. The multilayer coplanar waveguide phase shifter as defined in claim 7, wherein said photosensitive material layer comprises a layer of cadmium sulfur (CdS) material.

9. The multilayer coplanar waveguide phase shifter as defined in claim 1, wherein said photosensitive material layer comprises a photoconductive non-semiconductor material layer.

10. The multilayer coplanar waveguide phase shifter as defined in claim 9, wherein said photosensitive material layer comprises a layer of polyvinylcarbazole (PVK) material.

11. The multilayer coplanar waveguide phase shifter as defined in claim 1, further comprising a second conductive ground plane and a third dielectric layer, wherein said third dielectric layer is formed on said second conductive ground plane, and wherein said first dielectric layer is formed on said third dielectric layer.

12. The multilayer coplanar waveguide phase shifter as defined in claim 11, wherein said first dielectric layer has a higher dielectric constant than said third dielectric layer.

13. A multilayer coplanar waveguide phase shifter, said multilayer coplanar waveguide phase shifter comprising:

a first conductive ground plane;

a first dielectric layer formed on said first conductive ground plane;

a second dielectric layer formed on said first dielectric layer;

a conductive signal carrier and at least one second conductive ground plane flanking said conductive signal carrier, said conductive signal carrier and said at least one second conductive ground plane formed on said second dielectric layer;

a third dielectric layer formed on said conductive signal carrier, said at least one second conductive ground plane, and said second dielectric layer;

a plurality of fine-patterned conductive strips formed on said third dielectric layer; and a photosensitive material layer formed on said plurality of fine-patterned conductive strips and said third dielectric layer.

14. The multilayer coplanar waveguide phase shifter as defined in claim 13, wherein said second dielectric layer has a higher dielectric constant than said first dielectric layer, and wherein said second dielectric layer has a higher dielectric constant than said third dielectric layer.

15. The multilayer coplanar waveguide phase shifter as defined in claim 13, wherein said plurality of fine-patterned conductive strips are oriented perpendicular to said conductive signal carrier.

16. The multilayer coplanar waveguide phase shifter as defined in claim 13, wherein said at least one second conductive ground plane comprises two second conductive ground planes each laterally flanking said conductive signal carrier.

17. The multilayer coplanar waveguide phase shifter as defined in claim 16, wherein said conductive signal carrier has a width W, wherein said two second conductive ground planes are separated from said conductive signal carrier by a distance S, and wherein each of said plurality of fine-patterned conductive strips have a length of at least three times the dimension (2S+W).

18. The multilayer coplanar waveguide phase shifter as defined in claim 17, wherein said two second conductive ground planes each have a width that is at least equal to the dimension (2S+W).

19. The multilayer coplanar waveguide phase shifter as defined in claim 13, wherein said photosensitive material layer comprises a photosensitive semiconductor material layer.

20. The multilayer coplanar waveguide phase shifter as defined in claim 19, wherein said photosensitive material layer comprises a layer of cadmium sulfur (CdS) material.

21. The multilayer coplanar waveguide phase shifter as defined in claim 13, wherein said photosensitive material layer comprises a photoconductive non-semiconductor material layer.

22. The multilayer coplanar waveguide phase shifter as defined in claim 21, wherein said photosensitive material layer comprises a layer of polyvinylcarbazole (PVK) material.

23. A phase shifting device, said phase shifting device comprising:

a multilayer coplanar waveguide having a dielectric substrate with a conductive signal carrier formed thereon;

a first dielectric layer formed on said conductive signal carrier and said dielectric substrate;

a plurality of fine-patterned conductive strips formed on said first dielectric layer; and a photosensitive material layer formed on said plurality of fine-patterned conductive strips and said first dielectric layer.

24. The phase shifting device as defined in claim 23, wherein said dielectric substrate has a higher dielectric constant than said first dielectric layer.

25. The phase shifting device as defined in claim 23, wherein said plurality of fine-patterned conductive strips are oriented perpendicular to said conductive signal carrier.

26. The phase shifting device as defined in claim 23, wherein said dielectric substrate also has at least one conductive ground plane flanking said conductive signal carrier.

27. The phase shifting device as defined in claim 26, wherein said at least one conductive ground plane comprises two conductive ground planes each laterally flanking said conductive signal carrier.

28. The phase shifting device as defined in claim 27, wherein said conductive signal carrier has a width W, wherein said two conductive ground planes are separated from said conductive signal carrier by a distance S, and wherein each of said plurality of fine-patterned conductive strips have a length of at least three times the dimension (2S+W).

29. The phase shifting device as defined in claim 28, wherein said two conductive ground planes each have a width that is at least equal to the dimension (2S+W).

30. The phase shifting device as defined in claim 23, wherein said photosensitive material layer comprises a photosensitive semiconductor material layer.

31. The phase shifting device as defined in claim 30, wherein said photosensitive material layer comprises a layer of cadmium sulfur (CdS) material.

32. The phase shifting device as defined in claim 23, wherein said photosensitive material layer comprises a photoconductive non-semiconductor material layer.

33. The phase shifting device as defined in claim 32, wherein said photosensitive material layer comprises a layer of polyvinylcarbazole (PVK) material.

* * * * *